United States Patent [19]

Rogers et al.

[11] Patent Number: 4,836,067

[45] Date of Patent: Jun. 6, 1989

[54] PROTECTIVE SOCKET INSERT

[76] Inventors: Dale R. Rogers; Delton F. Rogers; Larry L. Rogers, all of 3144 S. 1200 West, Salt Lake City, Utah 84119

[21] Appl. No.: 735,562

[22] Filed: May 20, 1985

Related U.S. Application Data

[63] Continuation-in-part of Ser. No. 571,101, Jan. 16, 1984, abandoned.

[51] Int. Cl.[4] ..... B25B 13/58

[52] U.S. Cl. ..... 81/185; 81/125; 81/185.1

[58] Field of Search ..... 81/185, 186, 180 B, 81/121 R, 64, 185.1, 121.1, DIG. 11, 125

[56] References Cited

U.S. PATENT DOCUMENTS

| | | | |
|---|---|---|---|
| 2,491,089 | 12/1949 | Cowden | 81/125 |
| 2,651,230 | 9/1953 | Waterval | 81/185 X |
| 2,709,907 | 6/1955 | Robertson et al. | 81/125 X |
| 2,743,640 | 5/1956 | Verkuil | 81/64 |
| 3,027,790 | 4/1962 | Wagner | 81/121.1 |
| 3,433,108 | 3/1969 | Ondeck | 81/121.1 |
| 3,473,423 | 10/1969 | Peck | 81/64 |
| 3,678,789 | 7/1972 | Wilson | 81/121.1 |
| 3,834,253 | 9/1974 | Carr | 81/125 |
| 3,916,736 | 11/1975 | Clemens | 81/185 |

*Primary Examiner*—Debra Meislin

*Attorney, Agent, or Firm*—Rhodes, Coats & Bennett

[57] ABSTRACT

This invention is a socket insert to protect the finely finished surfaces of machinery and the nuts and bolts associated therewith. This protective insert is in the form of a nonmetallic material and is so sized that it will fit into a standard socket type tool with a smaller opening therein for engaging the nut or bolt to be manipulated. Because of a flare on the outer edge of the insert, the finish on the machinery that the nut or bolt is being used in conjunction with, will also be protected.

7 Claims, 2 Drawing Sheets

PROTECTIVE SOCKET INSERT

This is a continuation-in-part of U.S. Patent Application Ser. No. 06/571,101, filed Jan. 16, 1984, entitled "PROTECTIVE SOCKET INSERT" which is abandoned.

FIELD OF INVENTION

This invention relates to tools and more particularly to hand and power driven socket type tools.

BACKGROUND OF INVENTION

Finely finished pieces of equipment such as mag or chrome wheels with matching lugs, chrome engine heads, and various plated and painted surfaces on boats, airplanes, automobiles, motorcycles and the like require care not to mar the surfaces thereof during routine maintenance. When conventional socket wrenches and similar tools are used, even exercising care, the likelihood of scratching and otherwise damaging the surfaces is great. This scratching and damaging during installation or repair causes rusting and otherwise mars and distorts the decorative surfaces and particularly the edges thereof. Each year literally millions of dollars worth of decorative chrome and other finely finished nuts, bolts and adjoining surfaces must be discarded and replaced because of cosmetic damage during routine mechanical maintenance with traditional metal sockets and wrenches.

BRIEF DESCRIPTION OF INVENTION

After much research and study into the above-mentioned problems, the present invention has been developed to provide a means for continued use of standard metal socket sets while at the same time protecting the fine finish on nuts and bolts being manipulated as well as the adjoining machine surfaces. In addition to protecting cosmetic surfaces from damage, the present invention is useful in fields such as the aerospace industry where softer metals and plastics are used for nut and bolt heads while at the same time precise dimensions must be maintained. Further, the present invention has the advantage of preventing random sparks from setting off flammable substances or gases which may exist in garages, around oil wells, gas lines and the like due to the elimination of metal to metal contact between the tool and the device being manipulated.

The above is accomplished by providing a nonmetallic insert having an exterior configuration the same as the interior configuration of a standard socket with a central opening in the insert for engaging the nut or bolt to be manipulated. This insert is preferably formed from high density plastic such as nylon, mylar or the like. The type of high density nylon that is used in automobile engine timing chains has been found very suitable for this purpose.

In view of the above, it is an object of the present invention to provide a protective means for nuts and bolts which is usable with conventional sockets.

Another object of the present invention is to provide a means for preventing damage to the finely finished surfaces of nuts, bolts and adjacent parts during manipulation.

Another object of the present invention is to provide a relatively inexpensive and yet highly efficient means for protecting the surface of nuts and bolts being manipulated.

Another object of the present invention is to provide a means in the form of a protective insert for protecting the finely finished surfaces of nuts and bolts during manipulation using standard socket drives.

Another object of the present invention is to provide a high density plastic insert for use in conjunction with socket type wrenches for manipulating finely finished nuts and bolts.

Other objects and advantages of the present invention will become apparent and obvious from a study of the following description and the accompanying drawings which are merely illustrative of such invention.

BRIEF DESCRIPTION OF INVENTION

DETAILED DESCRIPTION OF INVENTION

Figure 1:
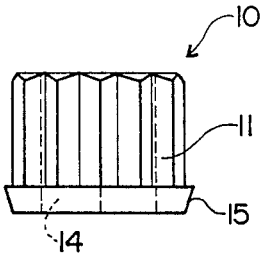
FIG. 1 is a side elevational view of the protective socket insert of the present invention.

With further reference to the drawings, the protective socket insert of th present invention, indicated generally at 10, is formed from a suitable high density, nonmetallic material such as nylon, mylar or the like.

The outer surface 11 of the insert is so configured as to matingly engage the interior surface 12 of standard socket 13 used in conjunction with either hand-manipulated wrenches or power driven devices such as impact wrenches 19.

Centrally disposed longitudinally through insert 10 of the present invention is a nut or bolt head shaped opening 14 of standard size and configuration.

On the outer end of insert 10 is formed an outwardly projecting flange or lip 15. This flange or lip serves two purposes, first it gives gripping surface during insertion and removal of the insert from its associated socket 13 and secondly it acts as a nonmetallic spacer between said socket and the machine surface 16 associated with the nut or bolt 16 being driven. Thus it can be seen that the insert of the present invention protects not only nut or bolt head but also the adjacent machine or the surface associated herewith.

When the protective insert of the present invention is slipped into a standard socket 13, the exterior of such insert snugly engages the interior 12 of such socket with the inner edge of flange 15 resting juxtaposed to the outer end 18 of the socket.

It should be noted at this point that although the insert 10 is preferably used in conjunction with standard pre-existing sockets, due to the thickness of the walls of the insert, a socket larger than the nuts or bolt to be driven is used.

It is contemplated that a plurality of inserts will be available in sets to match given socket sets. The insert of the present invention can also act as a connector to allow metric sockets to be used with standard size nuts and bolts and vice versa.

Figure 3:
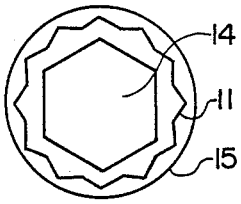
FIG. 3 is an inner end view thereof.
Figure 2:
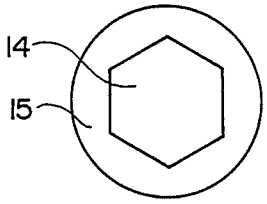
FIG. 2 is an outer end view thereof.
Figure 4:
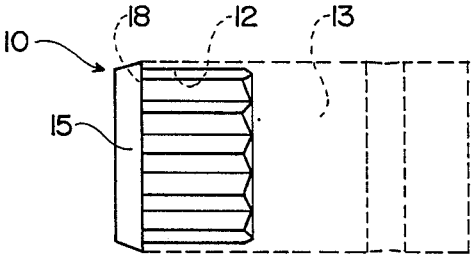
FIG. 4 is a side elevational view of a standard socket mounting the insert of the present invention.
Figure 5:
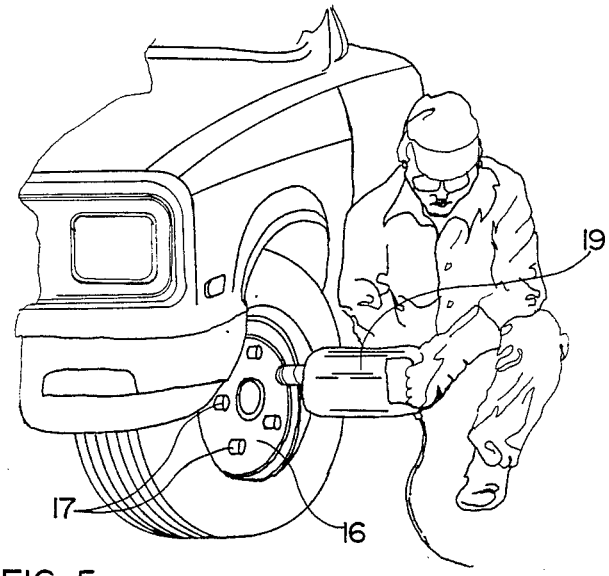
FIG. 5 is a perspective view of the protective socket insert of the present invention being used on a finely finished decorative surface during routine mechanical maintenance.
Figure 6:
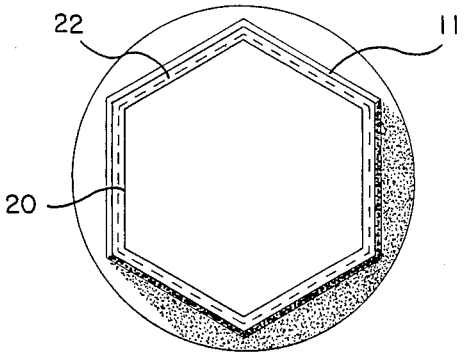
FIG. 6 is an inner end view of an insert having a hexagonal configuration.

As shown in FIG. 6 the outer surface 11 may be hexagonal in configuration. The hexagonal configuration has been found to be superior to the twelve-point configuration shown in FIGS. 1 and 3. The hexagonal insert will fit wrench means such as a standard lug wrench, crescent wrench, impact wrench or air gun, open-end wrench or crows foot wrench, as well as a standard socket. The twelve-point insert will not fit any of the above, with the exception of the standard socket.

Figure 7:
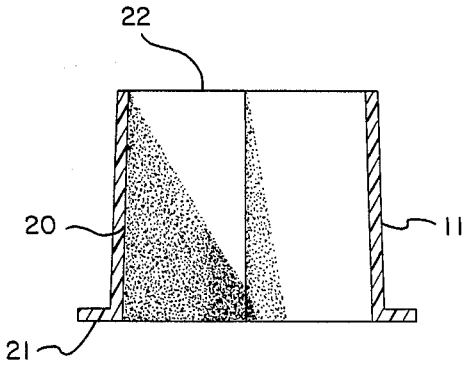
FIG. 7 is a cross-section taken through line 6—6 of the hexagonal insert.

Another improvement made in the hexagonal insert is its unique cross-sectional design. Referring to FIG. 7 it can be clearly seen that the walls 20 of the insert 10 are thicker at the flange end 21 of the insert than at the insert end 22. This imparts a 4% taper to the outer surface 11. Thus, the insert 10 will be held snugly by the wrench or socket because of the wedging action between the insert 10 and the wrench. Furthermore, it is seen that the interior dimension X of insert 10 is wider at the flange end 21 than at the insert end 22. This causes wedging action between the nut or bolt and the insert 10 so the nut will be retained by the insert 10.

From the above it can be seen that the present invention has the advantage of providing a means for preventing the scratching, distortion, or other marring of finely finished nut, bolt and machine parts while at the same time allowing such nuts and bolts to be manipulated in the usual manner. The insert of the present invention is relatively inexpensive to produce and yet greatly enhances the versatility of the socket used in conjunction therewith.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A nut and bolt protecting means comprising: wrench means of accepted size having an opening therein for receiving and engaging nuts and bolts of accepted size, a hexagonal wrench insert formed from a nonmetallic material including a continuous open-ended wall structure defining a nut and bolt receiving area therein so proportioned as to convert said opening from one standard size to a smaller standard size and an integrally formed flange portion at one end of side wall structure opposite the insert end of said wall structure, said wall structure (being) including an exterior surface tapered inwardly from said flange portion so that the exterior surface of said wall structure will increasingly engage said wrench as said insert is pressed into said opening therein and an interior surface tapered inwardly from said flange so that said interior surface of said wall structure will increasingly engage said nuts and bolts as the same are inserted into said nut and bolt receiving area, whereby finely finished nuts and bolts can be manipulated with standard wrench means without marring or otherwise damaging the surface of such nuts and bolts and whereby surfaces adjacent to said nut and bolt being manipulated will be protected from marring by said flange portion of said insert.

2. The means of claim 1 wherein said nonmetallic material is high density nylon.

3. The means of claim 1 wherein said nonmetallic material is plastic.

4. The means of claim 1 wherein said nonmetallic material is mylar.

5. The means of claim 1 wherein said inserts converts standard American wrench means into a smaller metric wrench means.

6. The means of claim 1 wherein said insert converts metric size wrench means into a smaller American wrench means.

7. The nut and bolt protecting means of claim 1 wherein said wrench means is selected from the group consisting of a standard lug wrench, a crescent wrench, an impact wrench, an air gun, an open-end wrench, a crows foot wrench, and a standard twelve-point socket wrench.

* * * * *